US008256048B2

(12) United States Patent
Bly et al.

(10) Patent No.: US 8,256,048 B2
(45) Date of Patent: Sep. 4, 2012

(54) BED LIFT MECHANISM

(75) Inventors: Robert R. Bly, Wellington, OH (US); Kevin S. Wysocki, Grafton, OH (US)

(73) Assignee: Invacare Corporation, Elyria, OH (US)

( * ) Notice: Subject to any disclaimer, the term of this patent is extended or adjusted under 35 U.S.C. 154(b) by 847 days.

(21) Appl. No.: 12/246,635

(22) Filed: Oct. 7, 2008

(65) Prior Publication Data

US 2009/0094747 A1 Apr. 16, 2009

Related U.S. Application Data

(60) Provisional application No. 60/998,287, filed on Oct. 10, 2007.

(51) Int. Cl.
*A47B 1/00* (2006.01)

(52) U.S. Cl. ..... 5/627; 5/611; 5/620; 5/86.1; 296/20

(58) Field of Classification Search ..... 5/11, 611, 5/613, 617, 618, 620, 310–316, 13, 27, 28, 5/29, 30, 32.1–42.1, 110, 111, 112, 114, 5/20, 625–627, 86.1; 403/82; 108/116, 117, 108/125, 126, 129, 130, 131, 147.22, 145; 296/20; 128/845; 280/640; 606/242
See application file for complete search history.

(56) References Cited

U.S. PATENT DOCUMENTS

| | | | | |
|---|---|---|---|---|
| 2,017,321 | A * | 10/1935 | Moore | 297/111 |
| 2,596,986 | A * | 5/1952 | Curtis | 280/641 |
| 2,675,285 | A * | 4/1954 | Terry et al. | 5/618 |
| 4,780,918 | A * | 11/1988 | Hartline | 5/13 |
| 5,009,223 | A * | 4/1991 | DeFonce | 602/16 |
| 5,356,370 | A * | 10/1994 | Fleming | 602/16 |
| 5,418,987 | A * | 5/1995 | Yoshino | 5/11 |
| 5,537,700 | A * | 7/1996 | Way et al. | 5/611 |
| 5,615,431 | A * | 4/1997 | Vassilli | 5/610 |
| 6,473,922 | B1 | 11/2002 | Sommerfeld et al. | |
| 6,757,924 | B2 * | 7/2004 | Goodwin et al. | 5/602 |
| 6,868,567 | B2 * | 3/2005 | Edgerton | 5/611 |
| 6,920,656 | B2 | 7/2005 | Roussy | |
| 7,134,155 | B2 * | 11/2006 | Freeborn et al. | 5/611 |
| 7,334,277 | B2 * | 2/2008 | Johnson | 5/611 |

* cited by examiner

*Primary Examiner* — Robert G Santos
*Assistant Examiner* — Nicholas Polito
(74) *Attorney, Agent, or Firm* — Calfee, Halter & Griswold LLP

(57) ABSTRACT

A bed with a leg assembly coupled to a support link assembly by a joint, the joint comprising a slot having at least two paths. A support link assembly defining a length that automatically varies as the support link assembly moves relative to the leg assembly.

34 Claims, 8 Drawing Sheets

BED LIFT MECHANISM

RELATED APPLICATIONS

This application claims the benefit of U.S. provisional patent application Ser. No. 60/998,287 for BED LIFT MECHANISM filed Oct. 10, 2007, the entire disclosure of which is fully incorporated herein by reference.

BACKGROUND

Patients residing in long-term care facilities such as nursing homes and rehabilitation facilities usually require beds that include movable head end and foot end sections of the sleep surface. The sleep surface and related components are attached to a frame which provides a rigid supporting structure. Also attached to the frame are the components for elevating or tilting the bed frame relative to the support surface. These beds typically utilize multiple manual crank devices or electric actuators to provide separate elevating movement of the head end and foot end sections of the sleep surface and also to raise, lower or tilt the entire frame and sleep surface relative to the support surface.

SUMMARY

The present invention relates to a bed incorporating a leg assembly coupled to a support link assembly by a joint, the joint comprised of a slot having at least two paths. Another aspect of the present invention relates to a length that automatically varies as the support link assembly moves relative to the leg assembly.

DETAILED DESCRIPTION OF THE INVENTION

Figure 1:
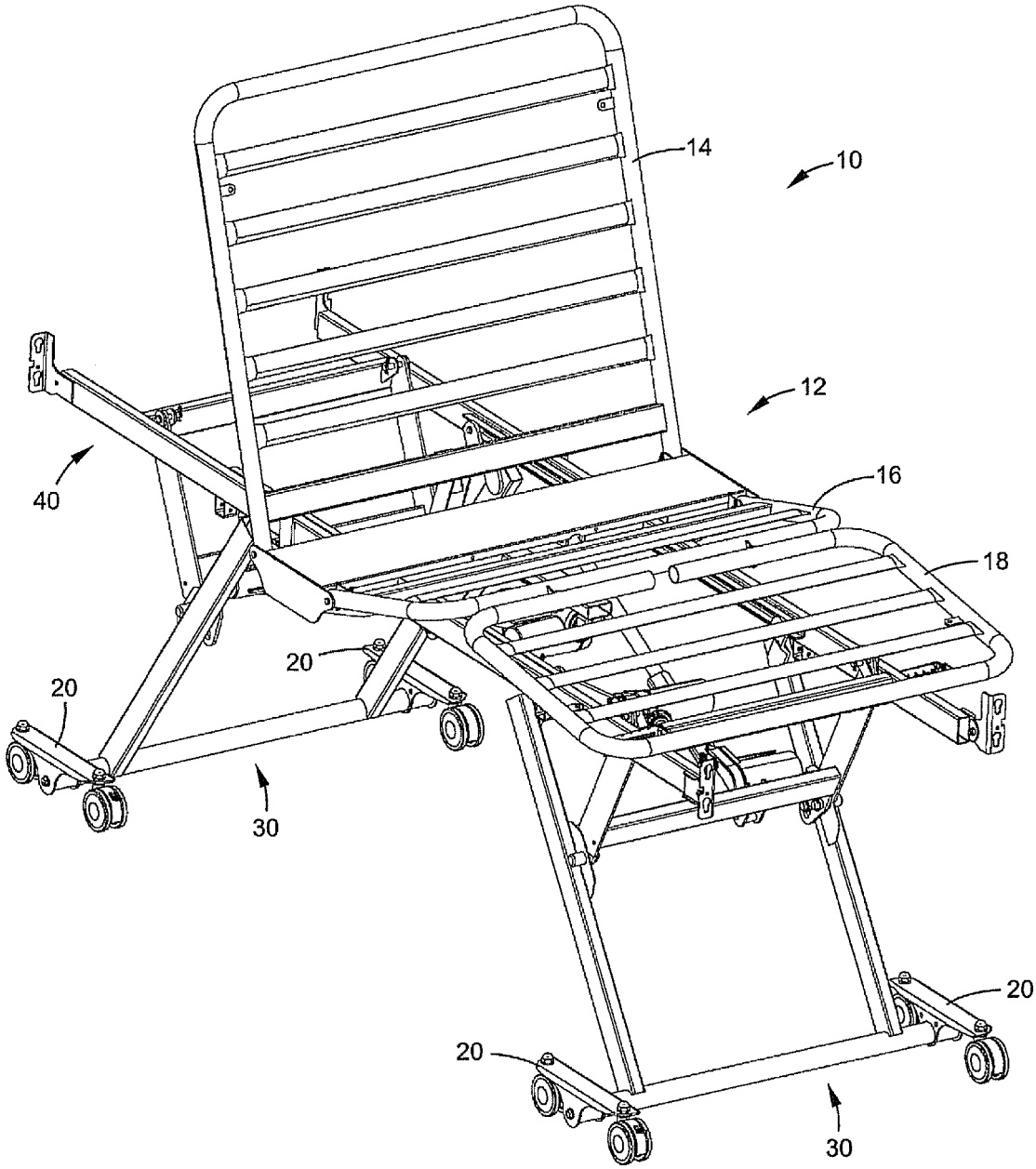
FIG. 1 is a perspective view of a long-term care bed according to one embodiment of the present invention with the head end sleep surface section elevated and the foot end sleep surface section partially elevated in the knee area.

A long-term care bed 10 as illustrated in FIG. 1 includes a frame 40 to which a sleep surface 12 is attached to provide a platform for a typical mattress. The sleep surface 12 is segmented into a head end frame section 14 and foot end frame sections 16 and 18. The head end frame section 14 can be elevated as shown in FIG. 1 by means of a lifting mechanism, such as an electric actuator or manual crank in conjunction with an appropriate structure. Likewise, the foot end frame sections 16 and 18 can be elevated as shown in FIG. 1 by a similar type of lifting mechanism employed for the head end frame section 14. The foot end frame sections 16 and 18 are pivotally coupled at or near the occupant's knee area to follow the natural contours of a person. As used herein, where two components are shown or described as being coupled, joined or connected, such coupling, joining or connecting can be accomplished directly between the two components or through one or more intermediary components.

The elevation of the frame 40 above a support surface can be adjusted or readjusted by means of two leg assemblies 30. Caster assemblies 20 are attached for pivotal movement to the lower outside ends of each leg assembly 30. Alternatively, wheels or fixed ground engaging elements can be used in place of caster assemblies 20. As will be described, the two leg assemblies 30 work in conjunction with other bed lift mechanism components to achieve zero or substantially zero horizontal or lateral movement of the caster assemblies 20 relative to the support surface when changing the elevation of the frame 40 above the support surface. It should be noted that the frame 40 can be tilted relative to the support surface to achieve a therapeutically desired Trendelenburg position.

Figure 2:
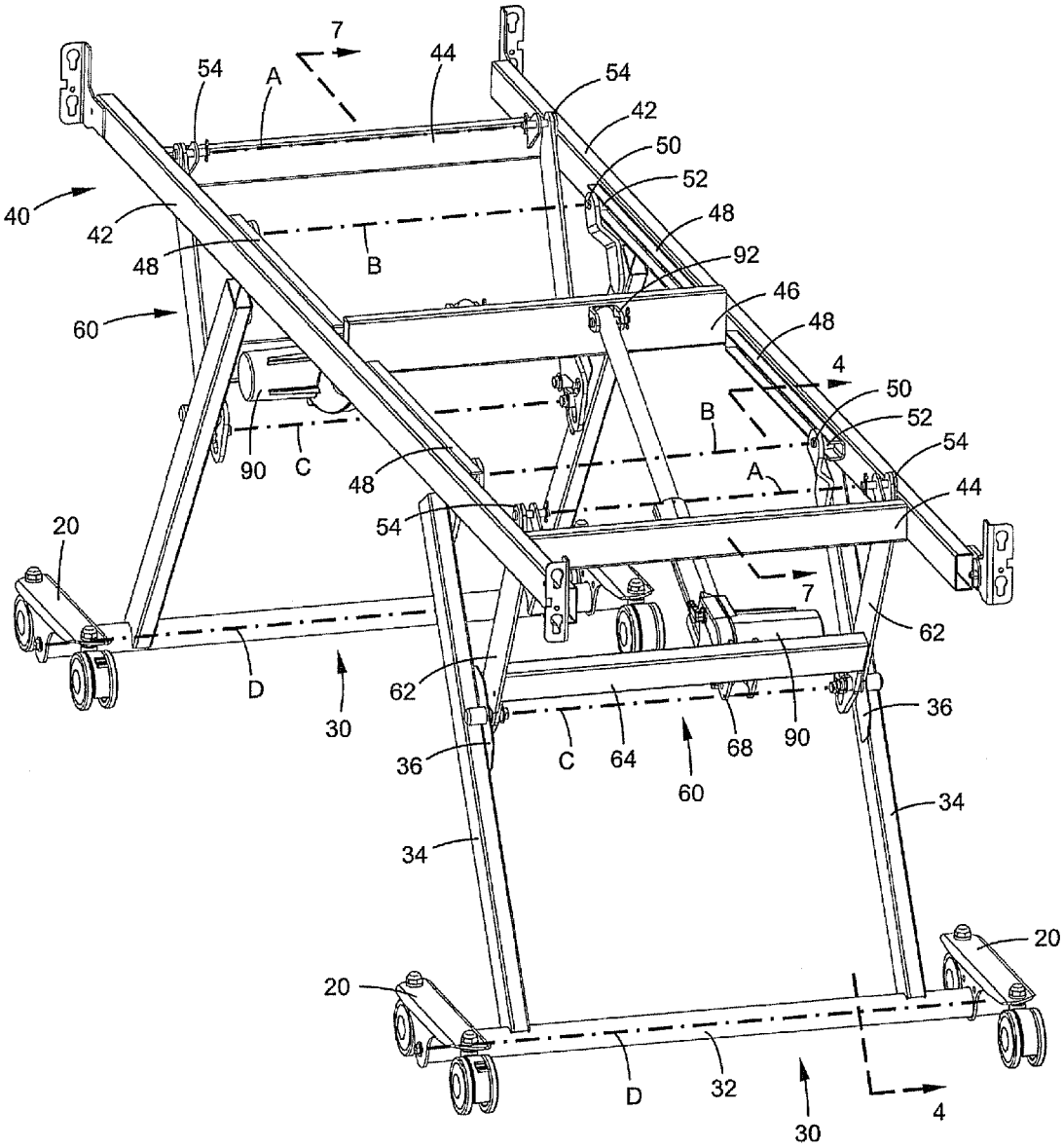
FIG. 2 is a perspective view of a long-term care bed according to one embodiment of the present invention with the sleep surface and related components removed.

Referring to FIG. 2, sleep surface 12 and related components are removed from frame 40 for clarity. Frame 40 provides the central structure to which the sleep surface 12, leg assemblies 30, support links 60 and actuators 90 are mounted. The frame 40 is comprised of opposing side rails 42, two end cross rails 44 and central cross rail 46. The side rails 42 and cross rails 44 and 46 are made from metal tubing and can be of various cross-sectional shapes such as round, square, rectangular or the like. The side rails 42 are laterally spaced apart and substantially parallel to each other and provide mounting surfaces for other components. Cross rails 44 and 46 span laterally between and are joined to the side rails 42 and also provide mounting surfaces for other components. Attached to the inside vertical surfaces of side rails 42 are four tracks 48 which are made from "U-shaped" or similarly shaped metal channel and are located so as to provide a guide means for the upper portion of leg assemblies 30.

In the present embodiment as shown in FIG. 2, leg assemblies 30, work in conjunction with support links 60 and actuators 90 to support and position frame 40 relative to the support surface. Leg assemblies 30 can be made to move in unison so as to position and maintain the frame 40 substantially horizontal with respect to the support surface or can be separately commanded such that the head or foot end is positioned higher than the other for the therapeutic Trendelenburg position. In this embodiment, leg assemblies 30 and support links 60 are substantially identical in appearance and function, but they can be configured differently as design requirements dictate.

The main portion of leg assembly 30 is comprised of caster tube 32 and legs 34. Legs 34 are positioned laterally apart and substantially parallel to each other and joined at their lower ends to cross tube 32 to form a substantially "U-shaped" structure. Caster assemblies 20 are pivotally attached to the outer ends of cross tube 32 and allow leg assembly 30 to rotate about the longitudinal axis of cross tube 32 designated as pivot axis D. Legs 34 are metal tubing with any of a variety of cross-sectional shapes such as round, square, rectangular or the like and can be straight as shown or incorporate curved regions.

Figure 3:
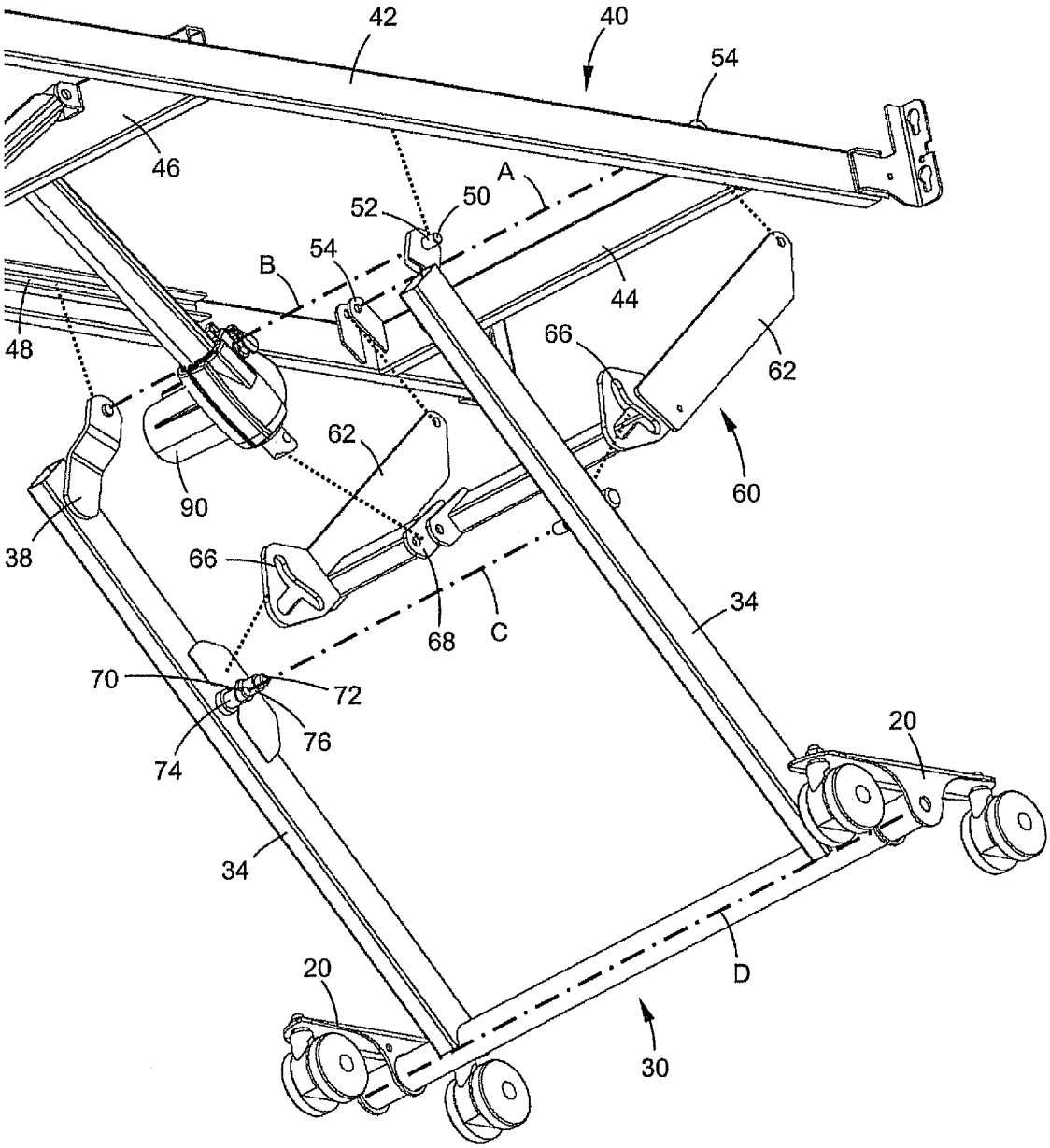
FIG. 3 is an exploded perspective view of one end of a long-term care bed according to one embodiment of the present invention.
Figure 4:
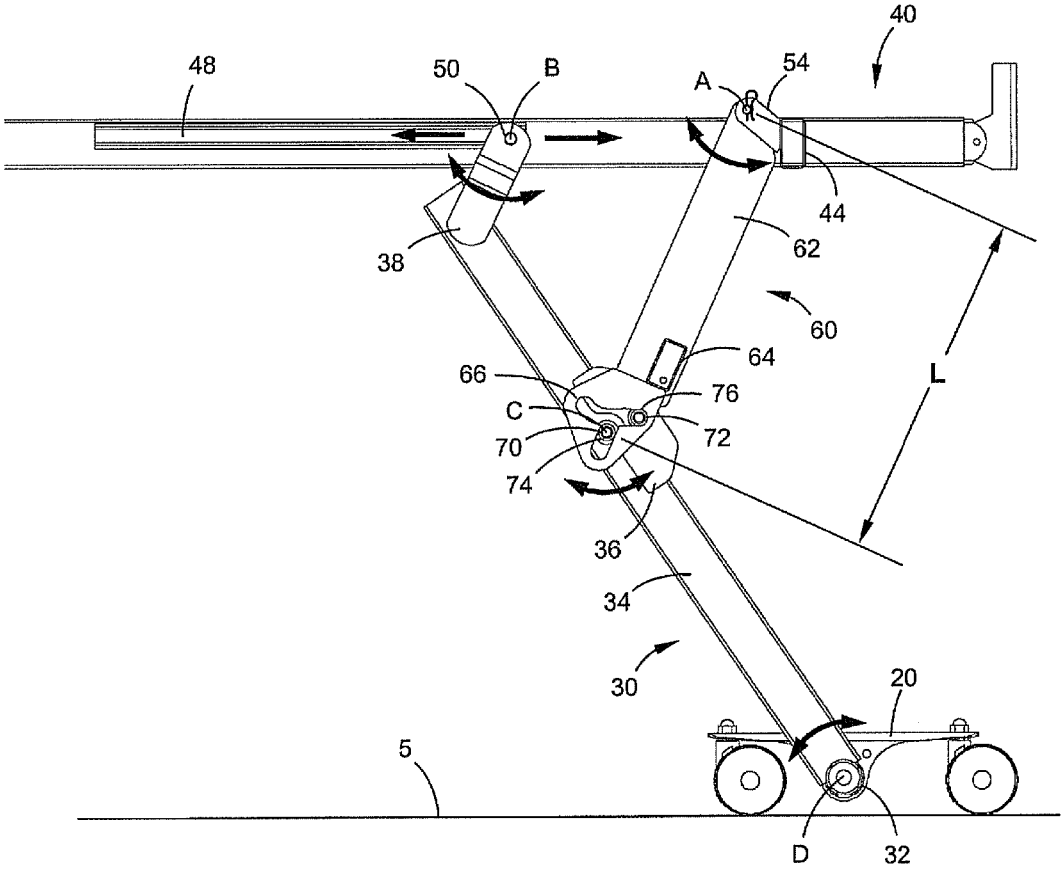
FIG. 4 is a cross-sectional view of one end of the bed lift mechanism taken along section line 4-4 in FIG. 2.

Referring to FIGS. 2-4, attached to each leg 34 is shield 36, bracket 38 and pins 70 and 72. Shield 36 is made from flat sheet metal and covers the mechanism to prohibit finger access and therefore eliminate any potential pinch point. Bracket 38 is attached near the upper end of leg 34 at approximately a 45° degree angle although the angle and placement can vary depending on design requirements. Pin 50 has a metal cylindrical shape and is attached to bracket 38 and projects substantially perpendicular in an outward direction. Low friction roller 52 is installed on pin 50 for engaging with and translating longitudinally in track 48. Roller 52 can be a conventional bushing, bearing or similar device and constructed of various metal or plastic materials. Roller 52 is retained on pin 50 by only the limited clearance between the end of pin 50 and track 48, although if needed, any conventional retaining means such as a screw, nut, clip or the like could be employed to retain the roller 52 on pin 50. The longitudinal axes of pins 50 on opposing brackets 38 are aligned so as to be substantially coaxial and define a pivot axis about which the upper ends of leg assembly 30 rotate and laterally translate and is designated as pivot axis B. So constructed, pivot axis B forms or approximates a pivot axis spanning laterally across frame 40 since the upper ends of leg assembly 30 will move substantially in unison.

Pins 70 and 72 are preferably metal and cylindrical in shape and are joined to leg 34 so that their longitudinal axes project substantially perpendicular to the inside surface of leg 34. The longitudinal axes of pins 70 on opposing legs 34 are aligned so as to be substantially coaxial. So constructed, the axes of pins 70 forms or approximates a pivot axis spanning laterally across leg assembly 30 and is designated as pivot axis C. Likewise, the longitudinal axes of pins 72 on opposing legs 34 are aligned so as to be substantially coaxial. Although it is shown that pins 70 and 72 project inwardly toward the longitudinal center line of bed 10, the mechanism can be rearranged so that pins 70 and 72 project perpendicularly outward from leg 34. Low friction rollers 74 and 76 are installed on pins 70 and 72 respectively for engaging with and following the contour of a slot 66 described later in more detail. Rollers 74 and 76 can be a conventional bushing, bearing or similar device and be constructed of various metal and plastic materials. Rollers 74 and 76 are retained on pins 70 and 72 respectively by any conventional retaining means such as a screw, nut, clip or the like.

Support link 60 is comprised of two links 62, cross member 64 and bracket 68. Links 62 are positioned laterally apart and substantially parallel to each other and are joined at their lower ends to cross member 64 to form a substantially "U-shaped" structure. The upper end of each link 62 contains a through hole for pivotal attachment to brackets 54 by means of a bolt, pin or the like. Brackets 54 are formed from metal as one piece or by combining two pieces and are mounted by any conventional means to rails 42 and/or cross rails 44. The through holes in brackets 54 at each end of bed frame 40 are aligned so as to be coaxial and thus create pivot axis A. These pivoting joints may also employ conventional bushings or bearings in the link 62 holes and/or the bracket 54 holes to reduce friction and/or noise.

Cross member 64 enables both links 62 to move in unison and also allow for one actuator 90 to be used for each end of bed 10. Cross member 64 is made from metal and can have a cross-sectional shape such as circular, square, rectangular, etc. Bracket 68 is formed or cast from metal as a separate component or can be integrated with cross member 64 into one larger casting. Bracket 68 is centrally located on cross member 64 and projects towards the center of bed 10.

Links 62 are mirror images of each other about the bed 10 longitudinal centerline. Each link 62 can be one piece or a multi-piece assembly made from metal and formed by any conventional fabrication process such as machining, stamping, laser cutting, welding, etc. or cast and machined by any well-known conventional processes. At the lower end of link 62 is slot 66 depicted in FIGS. 3-4 as substantially "T" shaped with an upper path being arcuate or semi-arcuate, and the lower path being mostly straight. Alternatively, slot 66 could be inverted such that the mostly straight path is oriented above the arcuate path or even segmented into two separate slots with paths of either orientation. The exact shape of slot 66, including the number of paths, can be developed using CAD software or manually using prototype materials.

The behavior of the bed lift mechanism is dependent on the shape of slot 66 and can be configured such that the caster assemblies 20 are motionless relative to support surface 5 during raising or lowering of the frame 40 above support surface 5, or in specific situations where movement of the caster assemblies 20 is desired, the slot 66 shape can be tailored to achieve the desired movement. It is understood that alternate arrangements of the slot 66 shape may cause various desired forms of frame 40 movement. For example, alternate slot 66 shapes may include causing frame 40 to initially rise slowly away from the support surface 5 to minimize loading on the actuator 90 or to minimize any jolting movement to the occupant. Yet another alternate slot 66 shape may cause the frame 40 to translate horizontally a short distance away from an adjacent object such as a wall or furniture before rising vertically. Other movements are also possible including combinations of the preceding.

Referring back to FIGS. 2-3, actuators 90 extend and contract in length in response to control signals to provide the motive force that elevates the frame 40 above the support surface 5. Actuators of this type as well as the control elements used to generate the control signal are well known in the art. An example of such electric actuators is Linak® linear actuator model no. LA27. It is also possible that a manually-operated crank-type mechanism could be substituted for the electric actuators. One end of actuator 90 is pivotally attached to bracket 92 by means of a bolt, pin or the like while the opposite end of the actuator 90 is pivotally attached to bracket 68 also by means of a bolt, pin or the like. Bracket 92 is formed in the same manner as brackets 54 and mounted by any conventional means to central cross rail 46. The actuator 90 pivoting attachment joints may also employ conventional bushings or bearings to reduce friction and/or noise. Alternately, it is possible that instead of actuator 90 applying the motive force to support link 60 via bracket 68, it could apply the motive force to leg assembly 30 if a crossbar similar to crossbar 64 with actuator mounting bracket 68 were added to leg assembly 30.

Actuator 90 positions support link 60 which in turn determines the position and motion of leg assembly 30. The extension in length of actuator 90 rotates support link 60 counterclockwise about pivot axis A as viewed in FIG. 4 which in turn transmits the motive force to leg assembly 30 via the sliding pivotal interface at pivot axis C. The motive force rotates leg assembly 30 clockwise about pivot axis D without imparting any translational forces to caster assemblies 20 thereby prohibiting any horizontal movement of the caster assemblies 20. While leg assembly 30 rotates about pivot axis D thereby raising frame 40, it simultaneously translates and rotates the upper end of leg assembly 30 on roller 52 in track 48, moving pivot axis B closer to pivot axis A. The contraction in length of actuator 90 reverses this motion and pivots support link 60 clockwise about pivot axis A and allows leg assembly 30 to rotate counterclockwise about pivot axis D and thereby lower frame 40.

Leg assembly 30 is pivotally and slideably coupled to support link 60 at pivot axis C by the arrangement of the roller 74 in the lower path of slot 66 and roller 76 in the upper path of slot 66. Roller 74 contacts the left side surface of the lower path of slot 66 while roller 76 contacts the upper surface of the upper path of slot 66. The upper path is configured in such a manner that the distance from any point along the upper surface to pivot axis C could vary from any other point. Dimension L defines the variable radial distance between pivot axis C and pivot axis A. While roller 74 at pivot axis C provides a sliding pivotal connection between leg assembly 30 and support link 60, roller 76 bearing against the upper surface of the upper path of slot 66 controls the variable length L. The rotation of leg assembly 30 relative to support link 60 causes roller 76 to follow the upper path of slot 66, which because of its shape, automatically changes the distance from pivot axis A to the contact point between roller 76 and the upper surface of the upper path. This varying distance causes roller 74 to translate longitudinally in the lower path of slot 66 and, in effect, constantly change the length L thereby providing a variable length connection between pivot axis A and pivot axis C. In one embodiment, length L changes by approximately one inch as frame 40 is elevated from its lowest position relative to the support surface to its fully elevated position.

Figure 5A:
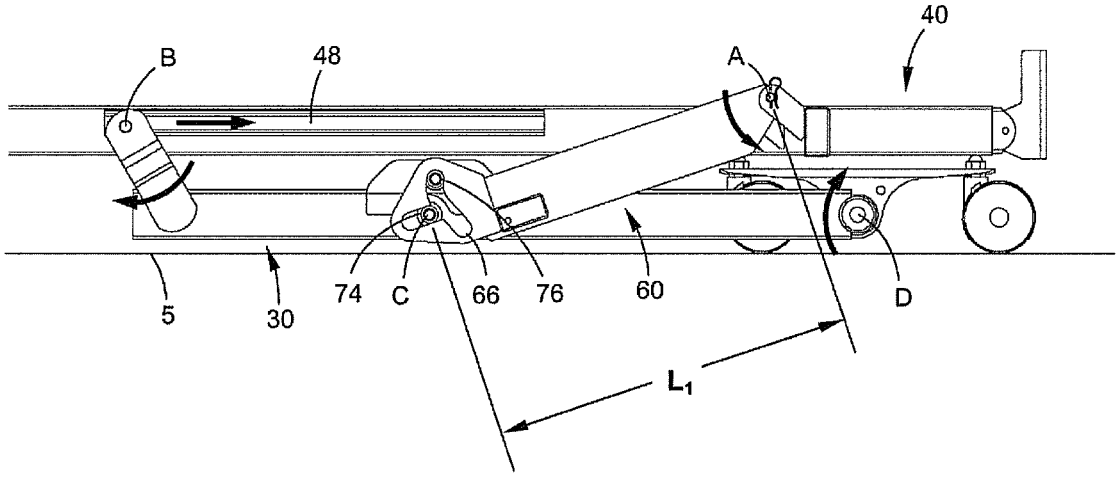
FIG. 5A illustrates the components of FIG. 4 with the bed frame at its lowest position relative to the support surface.

To illustrate how frame 40 is raised relative to support surface 5, it will be assumed that frame 40 is being raised substantially horizontal and both leg assemblies 30 perform in the identical manner, therefore only the operation of one combination of leg assembly 30 and support link 60 will be described. FIG. 5A depicts the condition where actuator 90 is fully contracted in length and frame 40 is at its lowest position relative to support surface 5. Roller 76 is located at one end of the semi-arcuate portion of slot 66, while roller 74 is located at the upper end of the lower portion of slot 66. Length L is at its shortest length, $L_1$, and pivot axis B is at its farthest distance from pivot axis A. To effect raising of frame 40, actuator 90 begins to extend in length and applies a motive force to support link 60 which rotates it counterclockwise about pivot axis A. In response to the rotation of support link 60, leg assembly 30 begins to rotate clockwise about pivot axis D while simultaneously translating pivot axis B towards pivot axis A.

Figure 5B:
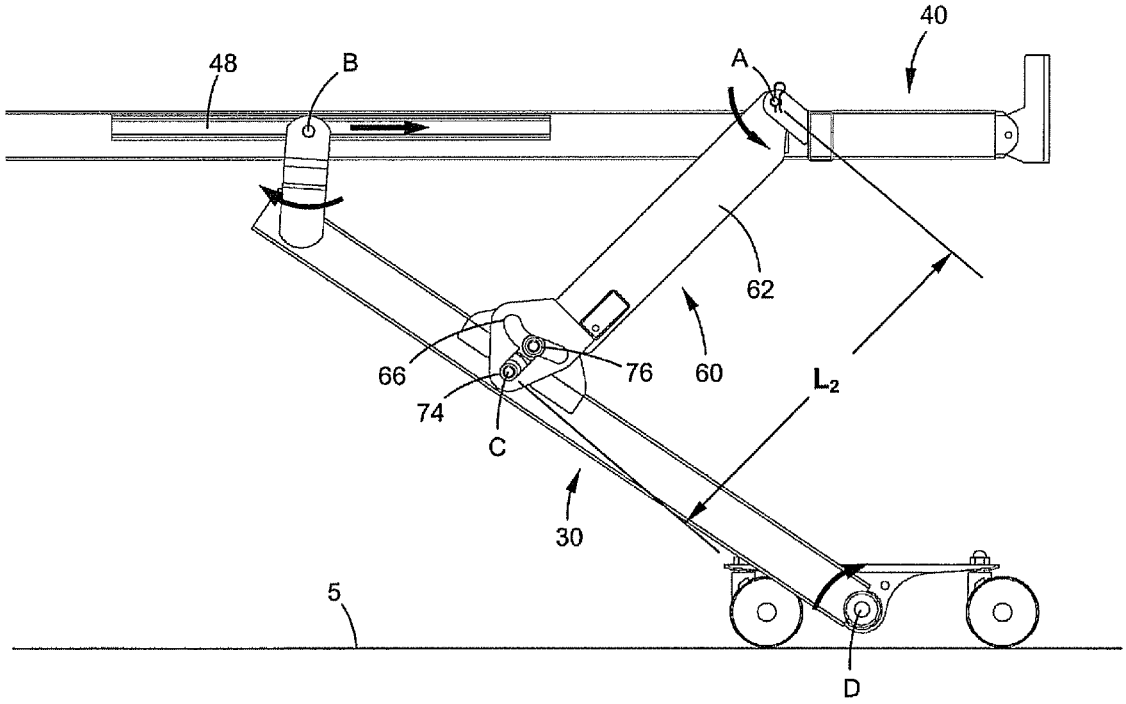
FIG. 5B illustrates the components of FIG. 4 with the bed frame at approximately its midpoint position relative to the support surface.

FIG. 5B depicts frame 40 after it has risen to approximately the midpoint of its vertical travel with respect to support surface 5. Actuator 90 has extended in length so as to further rotate support link 60 counterclockwise about the pivot axis A. Leg assembly 30 has further rotated clockwise about pivot axis D and translated pivot axis B towards pivot axis A. Roller 76 has moved to a position approximately at the midpoint of the semi-arcuate portion of slot 66 thereby automatically increasing length L from $L_1$ to $L_2$ as evidenced by roller 74 moving to the lower end of the lower portion of slot 66.

Figure 5C:
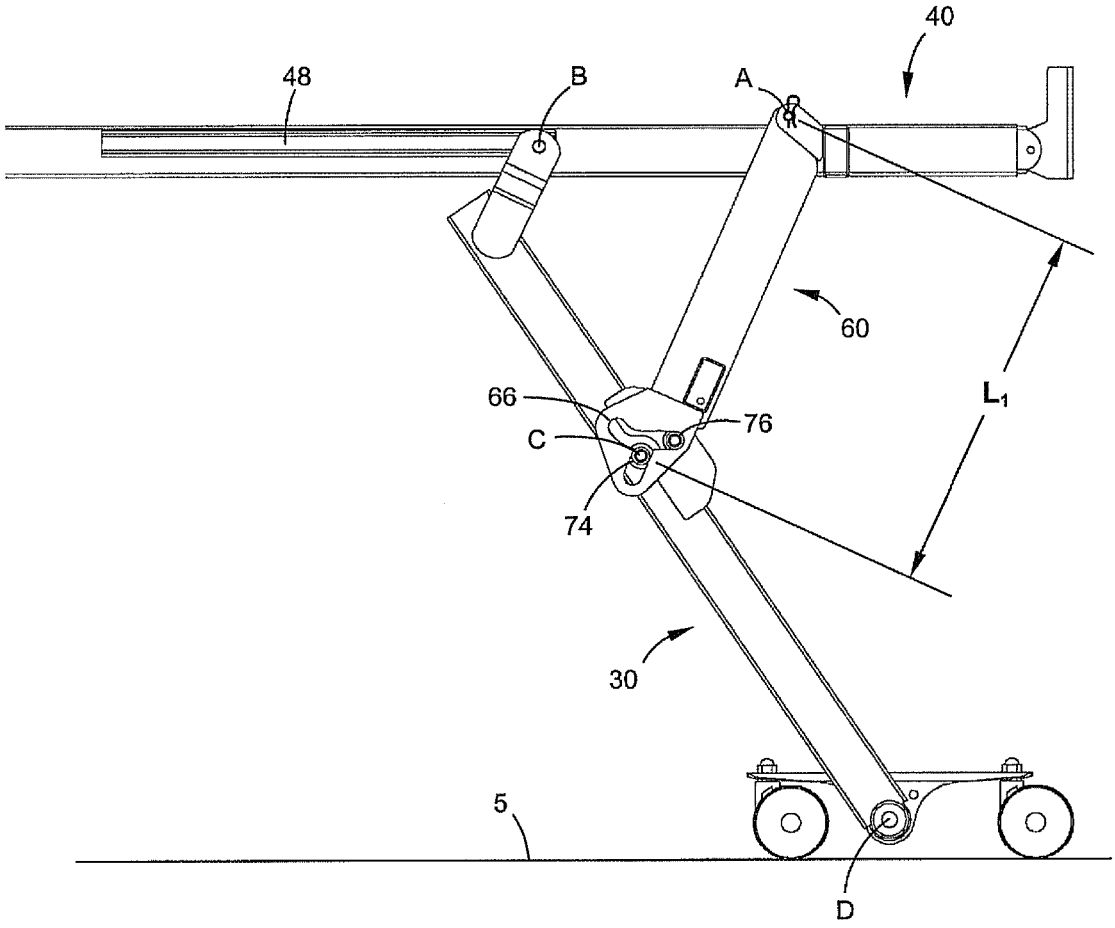
FIG. 5C illustrates the components of FIG. 4 with the bed frame at its highest position relative to the support surface.

FIG. 5C depicts frame 40 at a fully elevated position with respect to support surface 5. Actuator 90 has fully extended in length such that link 60 and leg assembly 30 are at their fully rotated positions and pivot axis B is at its closest distance to pivot axis A. Roller 76 has moved to a position at the other end of the upper portion of slot 66 and because of the shape of the upper portion of slot 66, it has automatically decreased length L from $L_2$ to $L_1$ as evidenced by roller 74 returning back to approximately its starting position close to the upper end of the lower portion of slot 66.

Lowering of frame 40 is accomplished by commanding the actuator to contract in length. This reverses the motion of all related components such that they follow the same path in moving to a lower vertical position. It is understood that frame 40 can be vertically positioned at any level within the range from its lowest position relative to support surface 5 to its highest position and can be subsequently repositioned in either direction as desired.

Figure 6A:
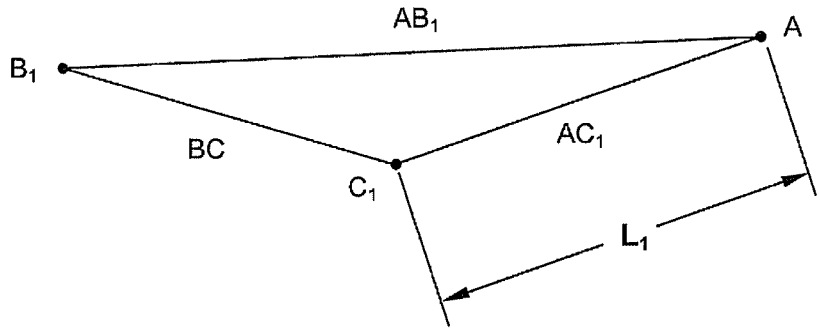
FIG. 6A is a schematic representation of the bed lift mechanism pivot positions of FIG. 5A.
Figure 6B:
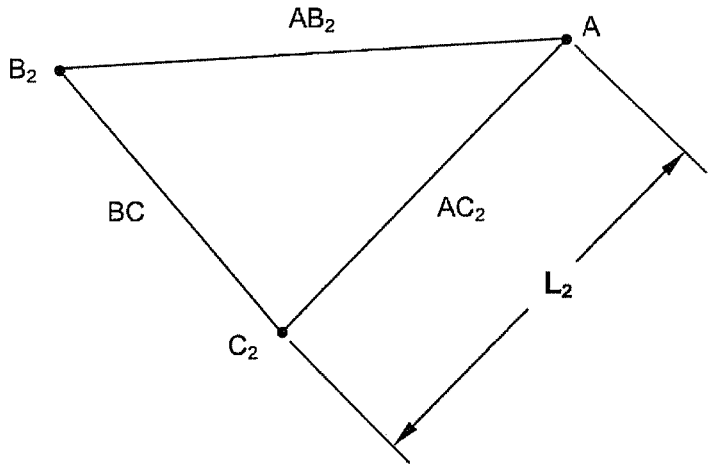
FIG. 6B is a schematic representation of the bed lift mechanism pivot positions of FIG. 5B.
Figure 6C:
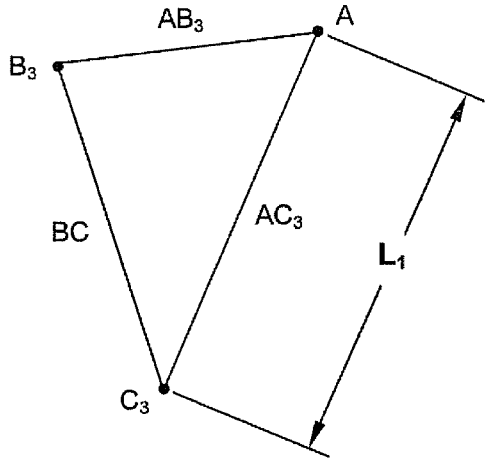
FIG. 6C is a schematic representation of the bed lift mechanism pivot positions of FIG. 5C.

FIGS. 6A-6C are schematic representations of the pivot point locations of FIGS. 5A-5C, respectively. It can be seen that the length L from pivot axis A to pivot axis C, denoted by AC, varies from $L_1$ in FIG. 6A to $L_2$ in FIG. 6B and returns back to $L_1$ in FIG. 6C. Also, it can be seen that the distance from pivot axis A to pivot axis B, denoted by AB, varies from FIG. 6A to FIG. 6C. The distance from pivot axis B to pivot axis C, denoted BC, remains constant in this embodiment. The relationship between these three pivot axis can be furthered represented by the following inequalities:

$AB_1 > AB_2 > AB_3$ $AC_1 < AC_2 > AC_3$

Figure 7A:
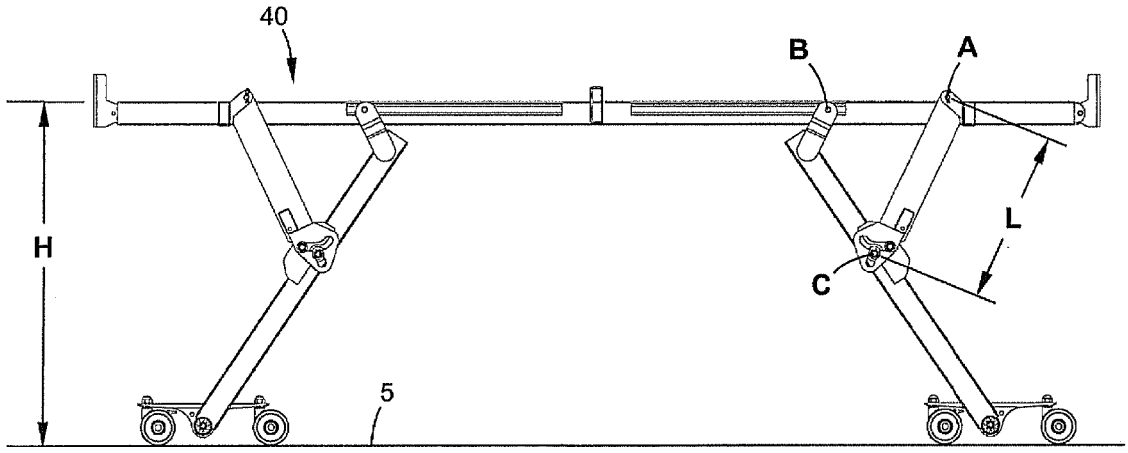
FIG. 7A is a cross-sectional view taken along section line 7-7 in FIG. 2 illustrating link length versus frame height.
Figure 7B:
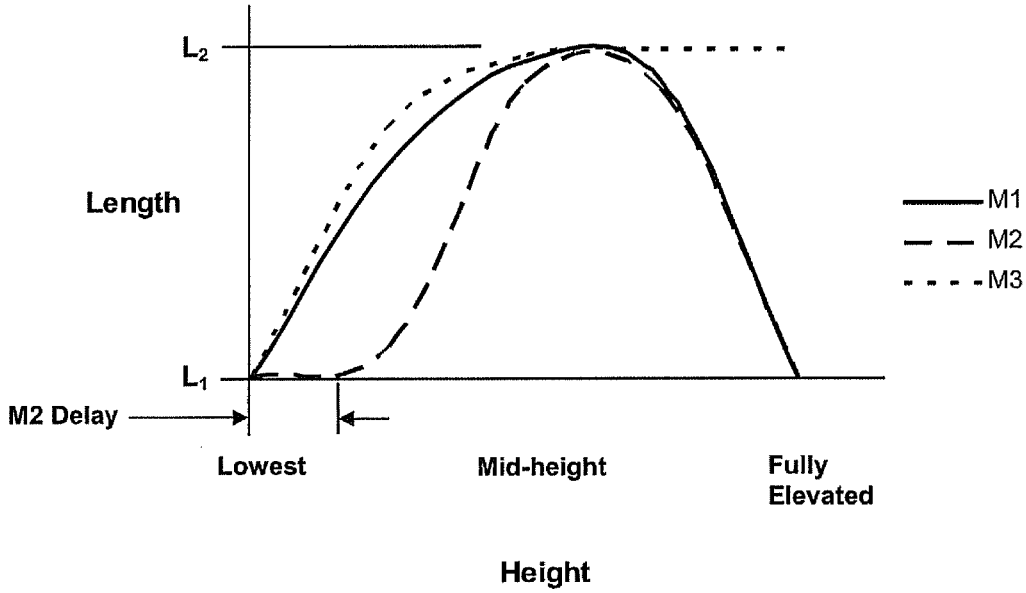
FIG. 7B is a graphical representation depicting several possible relationships between link length and frame height.

FIG. 7A illustrates dimension H as the height of frame 40 above the support surface 5 and dimension L as the distance between pivot axis A and pivot axis C. FIG. 7B is a plot of length L as it varies between $L_1$ and $L_2$ as a function of frame 40 height above support surface 5. When frame 40 is at its lowest position relative to support surface 5, length L is at its shortest length, $L_1$. As frame 40 elevates above support surface 5, length L automatically grows in length until it reaches its longest length $L_2$ when frame 40 is at approximately its mid-height position. As frame 40 continues to rise past the mid-height position, length L automatically contracts in length back to approximately its shortest length, $L_1$. This motion is represented by curve M1. The automatic length adjustment of length L can be configured such that it changes linearly, nonlinearly or a combination of both in relation to the frame 40 height change. Curve M2 depicts a motion where the automatic length adjustment of length L is delayed for an initial period of frame 40 height change. Curve M3 depicts a motion where the automatic length adjustment only extends length L as frame 40 changes height above support surface 5.

In an alternate embodiment, the bed lift mechanism can be configured such that support link 60 has only one link 62 to support the leg assembly 30. A single link 62 with slot 66 is positioned approximately at the longitudinal center line of bed 10. This single link 62 would be coupled to a single arrangement of rollers 74 and 76 located on a cross tube spanning between legs 34 of the leg assembly 30. The actuator 90 is pivotally coupled to either the support link 60 or the cross tube on leg assembly 30. The single link 62 would provide the identical lifting function as the two link 62 arrangement described previously, but may require other modifications or additional elements to keep the mechanism aligned and functioning properly. For instance, rollers 74 and 76 may need to be specified with a higher load rating to accommodate the increased loading that a single support link would carry. Also, rollers 74 and 76 may require some alignment features to mate consistently with slot 66 in link 62.

In another alternate embodiment, it may be desirable to raise and lower the frame 40 using only one actuator 90. In such a case, actuator 90 is connected to both leg assemblies 30 or to both support links 60 by appropriate cables, levers, rack and pinion gearing, or any other well known linkage mechanism. Actuator 90 is then able to reposition both ends of the bed lift mechanism simultaneously.

While the present invention has been illustrated by the description of embodiments thereof, and while the embodiments have been described in considerable detail, it is not the intention of the specification to restrict or in any way limit the scope of the appended claims to such detail. Additional advantages and modifications will readily appear to those skilled in the art. For example, individual components can be combined, assemblies can be divided into separate components or components can be rearranged without affecting the operation. Therefore, the invention, in its broader aspects, is not limited to the specific details, the representative apparatus, and illustrative examples shown and described. Accordingly, departures may be made from such details without departing from the spirit or scope of the applicant's general inventive concept.

Having described the invention, we claim:

1. A bed comprising:

a frame;

at least one leg assembly connected to the frame;

at least one support link assembly pivotally coupled to the frame and comprising:

a first portion connected to the frame; and a second portion coupled to the at least one leg assembly by a joint, the joint comprising a slot having a first path including first and second ends and a concave side and a convex side, and a second path extending from the convex side of the first path between the first and second ends.

2. A bed as set forth in claim 1 wherein the joint comprises a pivoting and sliding coupling between the at least one support link assembly and the at least one leg assembly.

3. A bed as set forth in claim 1 wherein the first path causes the at least one support link assembly to slide relative to the at least one leg assembly.

4. A bed as set forth in claim 1 wherein the second path comprises a sliding pivotal coupling between the at least one support link assembly and the at least one leg assembly.

5. A bed as set forth in claim 1 wherein the at least one leg assembly is pivotally and slideably coupled to said frame.

6. A lift mechanism for a bed comprising:

at least one leg assembly connected to a frame, the at least one leg assembly being pivotable and slideable with respect to the frame for vertical movement of the frame;

at least one support link assembly comprising:

a first portion connected to the frame at a first pivot axis; and a second portion connected to the at least one leg assembly by a joint, the joint comprising a slot receiving first and second pins attached to the at least one leg assembly; and an actuator connected between the frame and the at least one support link assembly, wherein operation of the actuator applies a force to the at least one support link assembly to pivot the at least one support link assembly about the first pivot axis with respect to the frame such that the joint applies a pivoting force to the at least one leg assembly, and the first and second pins travel within the slot to vary an effective length of the at least one support link assembly between the frame and the at least one leg assembly.

7. A lift mechanism as set forth in claim 6 wherein the joint comprises a pivoting and sliding coupling between the at least one support link assembly and the at least one leg assembly.

8. A lift mechanism as set forth in claim 6 wherein a path of the slot causes the at least one support link assembly to slide relative to the at least one leg assembly.

9. A lift mechanism as set forth in claim 6 wherein a path of the slot provides a sliding pivotal coupling between the at least one support link assembly and the at least one leg assembly.

10. A lift mechanism as set forth in claim 6 wherein the at least one leg assembly is pivotally and slideably coupled to said frame.

11. A lift mechanism as set forth in claim 6 wherein the at least one support link assembly is pivotally coupled to said frame.

12. A lift mechanism as set forth in claim 6, wherein the slot includes a first path and a second path extending transverse to the first path.

13. A bed comprising:

a frame;

a ground engaging element;

a leg having a first end pivotally and slideably connected to the frame and a second end connected to the ground engaging element, the leg being pivotable and slideable with respect to the frame for vertical movement of the frame with respect to the ground engaging element between a first vertical position and a second vertical position;

a support link coupled between the frame and the leg; and a joint coupling the support link to the leg, the joint including means for preventing horizontal movement of the ground engaging element as the leg pivots to move the frame between the first vertical position and the second vertical position wherein the support link slides and pivots relative to the leg.

14. A bed as set forth in claim 13 wherein the means for preventing horizontal movement of the ground engaging element comprises a path defining slot that causes the support link to slide relative to the leg.

15. A bed as set forth in claim 13 wherein the means for preventing horizontal movement of the ground engaging element comprises a path defining slot that provides a sliding and pivoting coupling between the support link and the leg.

16. A bed as set forth in claim 13 wherein the leg is pivotally and slideably coupled to said frame.

17. A bed as set forth in claim 13 wherein the support link is pivotally coupled to said frame.

18. A bed as set forth in claim 13, wherein when the frame is in a third vertical position between the first and second vertical positions, an effective length of the support link between the frame and the leg is greater than the effective length when the frame is in either of the first and second vertical positions.

19. A support link assembly for a bed comprising:

a first portion connected to a frame at a first pivot axis; and a second portion connected to a leg assembly by a joint comprising a slot receiving first and second pins attached to the leg assembly;

wherein when the leg assembly is pivotally and slideably coupled to the frame and is pivoted to move the frame from a first vertical position to a second vertical position, a position of the first and second pins within the slot automatically varies to adjust an effective length of the support link assembly between the frame and the leg assembly, wherein the effective length is at a maximum when the frame is in a third vertical position between the first and second vertical positions.

20. A bed comprising:

a frame;

a ground engaging element;

at least one leg assembly having a first end pivotally and slideably connected to the frame and a second end connected to the ground engaging element, the at least one leg assembly being pivotable and slideable with respect to the frame for vertical movement of the frame with respect to the ground engaging element;

at least one support link assembly comprising:

a first portion pivotally connected to the frame at a first pivot axis;

a second portion pivotally and slideably coupled to the at least one leg assembly at a second pivot axis by a joint, the joint comprising:

a slot having first and second paths;

a first roller following in the first path; and a second roller following in the second path; and wherein an effective length of the at least one support link assembly between the frame and the at least one leg assembly automatically varies as the at least one support link assembly moves relative to the at least one leg assembly, such that the at least one leg assembly is pivoted without imparting translational forces to the ground engaging element.

21. A lift mechanism as set forth in claim 12, wherein movement of the second pin is limited to the second path.

22. A lift mechanism as set forth in claim 21, wherein the effective length is measured from the first pivot axis to the second pin.

23. A lift mechanism as set forth in claim 12, wherein the first pin moves in the first path of the slot when the at least one leg assembly is pivoted to move the frame.

24. A lift mechanism as set forth in claim 12, wherein the second path is substantially straight.

25. A lift mechanism as set forth in claim 12, wherein the first path is semi-arcuate.

26. A lift mechanism as set forth in claim 12, wherein at least a portion of the first path is arcuate, with the second path extending from a convex side of the first path.

27. A bed as set forth in claim 20, further comprising an actuator connected between the frame and the second portion of the at least one support link assembly and operable to pivot the at least one support link assembly about the first pivot axis.

28. A bed comprising:

a frame;

a ground engaging element;

a leg having a first end pivotally and slideably connected to the frame and a second end connected to the ground engaging element, the leg being pivotable and slideable with respect to the frame for vertical movement of the frame with respect to the ground engaging element between a first vertical position and a second vertical position;

a support link coupled between the frame and the leg; and a joint coupling the support link to the leg, the joint being configured to prevent horizontal movement of the ground engaging element as the leg pivots to move the frame between the first vertical position and the second vertical position;

wherein the joint comprises first and second slot portions that slideably receive corresponding first and second pins attached to the leg, the first and second slot portions being shaped to move the leg with respect to the support link as the leg pivots to move the frame between the first vertical position and the second vertical position, to prevent horizontal movement of the ground engaging element.

29. A bed comprising:

a frame;

a ground engaging element;

a leg having a first end pivotally and slideably connected to the frame and a second end connected to the ground engaging element, the leg being pivotable and slideable with respect to the frame for vertical movement of the frame with respect to the ground engaging element between a first vertical position and a second vertical position;

a support link coupled between the frame and the leg; and a joint coupling the support link to the leg, the joint including means for preventing horizontal movement of the ground engaging element as the leg pivots to move the frame between the first vertical position and the second vertical position;

wherein the means for preventing horizontal movement of the ground engaging element comprises a path defining slot that causes the support link to slide relative to the leg.

30. A bed as set forth in claim 29 wherein the support link slides and pivots relative to the leg.

31. A bed comprising:

a frame;

a ground engaging element;

a leg having a first end pivotally and slideably connected to the frame and a second end connected to the ground engaging element, the leg being pivotable and slideable with respect to the frame for vertical movement of the frame with respect to the ground engaging element between a first vertical position and a second vertical position;

a support link coupled between the frame and the leg; and a joint coupling the support link to the leg, the joint including means for preventing horizontal movement of the ground engaging element as the leg pivots to move the frame between the first vertical position and the second vertical position;

wherein when the frame is in a third vertical position between the first and second vertical positions, an effective length of the support link between the frame and the leg is greater than the effective length when the frame is in either of the first and second vertical positions.

32. A bed as set forth in claim 31, wherein the effective length is at a minimum when the frame is in each of the first and second vertical positions.

33. A bed as set forth in claim 31, wherein the effective length varies by approximately 1 inch as the frame is moved between the first and second vertical positions.

34. A bed as set forth in claim 31, wherein the support link includes a first portion connected to the frame at a first pivot axis and a second portion connected to the leg by a joint comprising a slot receiving a pin attached to the leg, wherein the effective length is measured from the first axis to the pin.

* * * * *